US006991558B2

(12) United States Patent
Beach et al.

(10) Patent No.: US 6,991,558 B2
(45) Date of Patent: Jan. 31, 2006

(54) GOLF CLUB HEAD

(75) Inventors: Todd P. Beach, San Diego, CA (US); David Anderson, San Diego, CA (US); Benoit Vincent, Leucadia, CA (US)

(73) Assignee: Taylor Made Golf Co., Inc., Carlsbad, CA (US)

( * ) Notice: Subject to any disclaimer, the term of this patent is extended or adjusted under 35 U.S.C. 154(b) by 82 days.

(21) Appl. No.: 09/821,370

(22) Filed: Mar. 29, 2001

(65) Prior Publication Data

US 2002/0160854 A1 Oct. 31, 2002

(51) Int. Cl.
*A63B 53/04* (2006.01)
*A63B 53/06* (2006.01)

(52) U.S. Cl. ..... 473/324; 473/345; 473/349; 473/334; 473/338

(58) Field of Classification Search ..... 473/334, 473/340, 341, 345, 349, 350, 291, 314, 346, 473/324, 347, 338, 290
See application file for complete search history.

(56) References Cited

U.S. PATENT DOCUMENTS

| | | | | |
|---|---|---|---|---|
| 3,625,518 A | | 12/1971 | Solheim | |
| 3,652,094 A | | 3/1972 | Glover | |
| 3,761,095 A | * | 9/1973 | Thompson | 473/327 |
| 3,941,390 A | * | 3/1976 | Hussey | 273/169 |
| 4,085,934 A | * | 4/1978 | Churchward | 473/338 |
| 4,420,156 A | | 12/1983 | Campau | |
| 5,046,733 A | | 9/1991 | Antonious | |
| 5,058,895 A | | 10/1991 | Igarashi | |
| 5,141,230 A | | 8/1992 | Antonious | |
| 5,176,383 A | | 1/1993 | Duclos | |
| 5,251,901 A | | 10/1993 | Solheim et al. | |
| 5,273,283 A | * | 12/1993 | Bowland | 473/338 |
| 5,306,008 A | | 4/1994 | Kinoshita | |
| 5,421,577 A | | 6/1995 | Kobayashi | |
| 5,447,309 A | | 9/1995 | Vincent | |
| 5,547,427 A | | 8/1996 | Rigal et al. | |
| 5,851,160 A | * | 12/1998 | Rugge et al. | 473/349 |

(Continued)

FOREIGN PATENT DOCUMENTS

| | | |
|---|---|---|
| JP | H05-57034 | 3/1993 |

(Continued)

OTHER PUBLICATIONS

Simplifying the Science of Golf. Golf Magazine, Oct. 1999. pp. 86 and 95.

*Primary Examiner*—Sebastiano Passaniti
(74) *Attorney, Agent, or Firm*—Sheppard, Mullin, Richter & Hampton LLP

(57) ABSTRACT

A club head for a golf club comprises a strike face and an outer shell. The strike face and the outer shell define a head volume of the club head. The club head has a first axis that extends generally horizontally and parallel to the strike face, a first moment of inertia about the first axis, a second axis that lies generally vertically and perpendicular to the first horizontal axis, a second moment of inertia about the second axis, and a center of gravity lying below a horizontal centerline of the club head. The first moment of inertia in units of kg-mm$^2$ is greater than or equal to approximately 77 plus 0.46 times the head volume in units of cm$^3$.

55 Claims, 8 Drawing Sheets

U.S. PATENT DOCUMENTS

| | | | | |
|---|---|---|---|---|
| 5,885,166 | A | 3/1999 | Shiraishi | |
| 5,947,840 | A | 9/1999 | Ryan | |
| 6,012,990 | A | 1/2000 | Nishizawa | |
| 6,162,132 | A * | 12/2000 | Yoneyama | 473/338 |
| 6,254,494 | B1 | 7/2001 | Hasebe et al. | |
| 6,319,148 | B1 * | 11/2001 | Tom | 473/290 |
| 6,364,788 | B1 * | 4/2002 | Helmstetter et al. | 473/324 |
| 2002/0006836 | A1 * | 1/2002 | Helmstetter et al. | 473/345 |
| 2002/0091884 | A1 * | 7/2002 | Hocknell et al. | 473/334 |

FOREIGN PATENT DOCUMENTS

| | | |
|---|---|---|
| WO | WO 98/31434 | 1/1997 |
| WO | WO 98/341433 | 1/1998 |

* cited by examiner

GOLF CLUB HEAD

BACKGROUND OF THE INVENTION

1. Field of the Invention

The present invention relates to golf clubs, and, in particular, to a golf club head with a designated relationship between the volume of the club head and the rotational inertia of the club head about a particular axis.

2. Description of the Related Art

A wood-type golf club typically includes a hollow shaft with a golf club head attached to the lower end of the shaft. The club head typically includes a load-bearing outer shell with an integral or attached strike plate. The strike plate defines a front surface or strike face adapted for striking a golf ball.

The mass of a club head is limited by various practical considerations, such as the desire to keep the swing weight of the golf club close to a conventional value. Accordingly, most club heads have a mass between 180–250 grams. A certain portion of the club head's mass is reserved for components that provide structural support, such as the load bearing outer shell. The remaining mass, which is referred to as performance mass, can be distributed within the club head to optimize performance.

For some time, golf club manufacturers have searched for ways to best distribute the performance mass so as to improve club head performance. Recently, golf club manufacturers have attempted to position most of the performance mass along the perimeter of the club head so as to increase the rotational moment of inertia of the ("MOI") of the club head about the club head center of gravity ("CG"). In particular, many club heads include two or more weights spaced along the heel/toe axis (i.e., an axis that extends through the club head CG generally parallel to the strike face in a generally horizontal direction relative to the ground when the club head is at address position). Such perimeter weighting increases the MOI of the club head about the vertical axis (i.e., an axis that extends through the club head CG in a generally vertical direction relative to the ground when the club head is at address position). This tends to make the club head more resistant to twisting during off-center hits. However, as will be explained below, such perimeter weighting represents an inefficient use of the performance mass.

An exception to the general trend of heel/toe weighting is U.S. Pat. No. 5,176,383, which discloses a club head with a weight positioned at the rear of a support. The support and the weight are in-line with the center of percussion of the club head. This patent claims that this arrangement concentrates the inertial energy of the club head along the center of percussion, which, in turn, maximizes the amount of energy that is imparted to the golf ball. However, a golf club according to this patent disadvantageously has a CG that is above the horizontal centerline of the golf club.

Another aspect of the present invention is a club head comprising a strike face, an outer shell that defines an interior volume, and a plurality of weights. The plurality of weights are positioned substantially along a front/back axis that extends generally perpendicular from said strike face and are also positioned substantially below a horizontal centerline of said club head.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features of the invention will now be described with reference to the drawings of a preferred embodiment, which are intended to illustrate and not to limit the invention, and in which.

DETAILED DESCRIPTION OF THE PREFERRED EMBODIMENT

Figure 1:
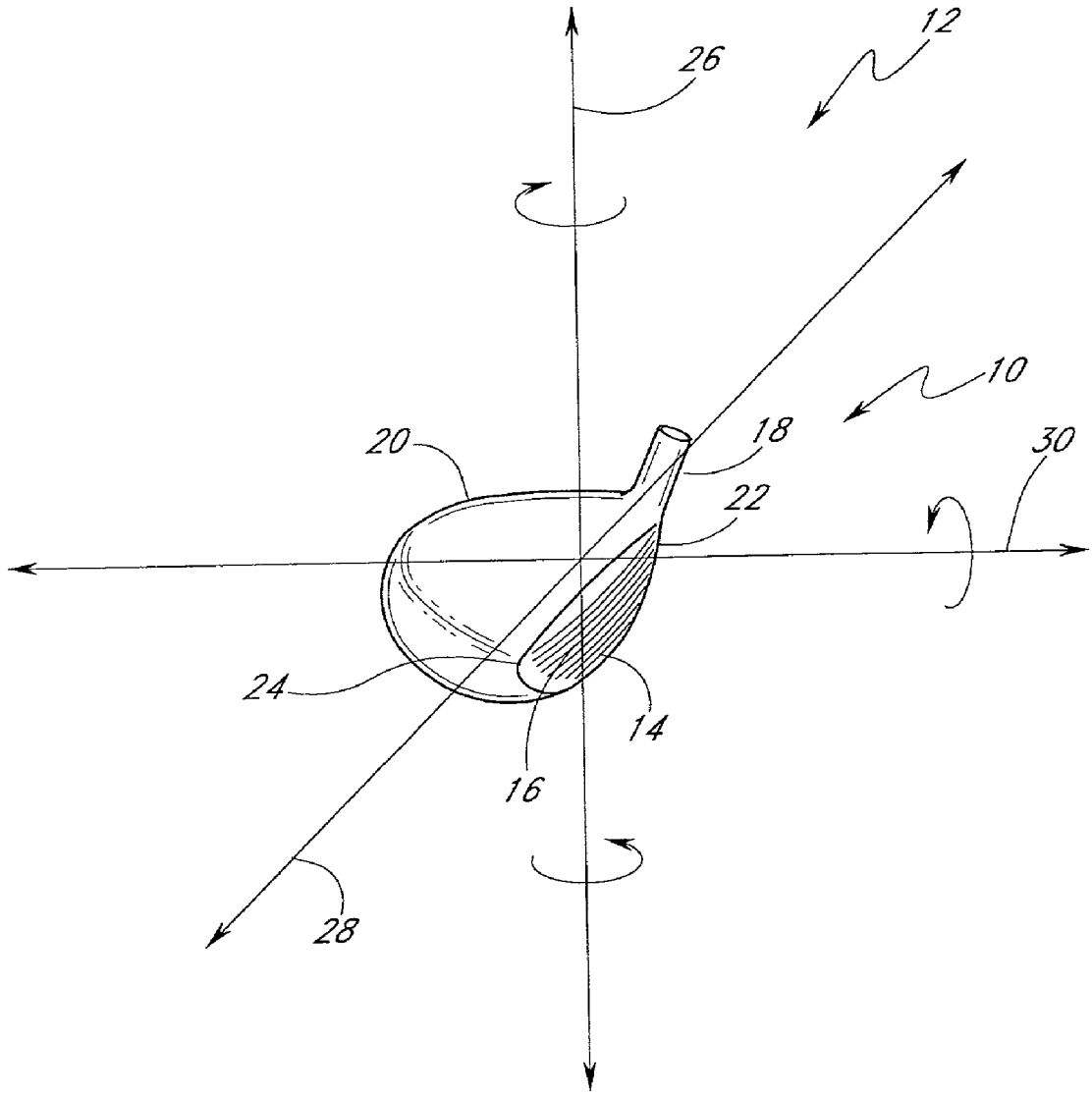
FIG. 1 is a front view of a golf club head centered about a coordinate system.

FIG. 1 is a perspective view of a club head 10 located about a coordinate system 12, The coordinate system 12 is centered about the center of gravity ("CG") of the club head As is typical in the art, the club head 10 comprises a strike plate 14, which defines a front surface or strike face 16 for impacting a golf ball. A hosel 18 extends upwardly from the strike plate 14. The hosel 18 is used to attach the club head 10 to a golf club shaft (not shown) as is well known in the art. The club head 10 also includes a load bearing outer shell 20 that is either integrally made with or attached to the strike plate 14. A heel region 22 of the club head 10 is located close to the hosel 18 while the toe region 24 of the club head is located opposite the heel region 22.

The coordinate system 12 comprises three axes: (i) a vertical axis 26 that extends through the CG generally parallel to the strike face 16 in a generally vertical direction relative to the ground when the club head 10 is at address position, (ii) a heel/toe axis 28 that extends through the CG generally parallel to the strike face 16 and generally perpendicular to the vertical axis 26, and (iii) a front/back axis 30 that extends through the CG generally perpendicular to the vertical axis 26 and the heel/toe axis 28. Heal/Toe axis and 28 and front/back axis 30 both extend in a generally horizontal direction relative to the ground when the club head 10 is at address position.

The club head 10 has a rotational moment of inertia (i.e., a resistance to twisting) about each of the three axes. Specifically, the club head 10 has a moment of inertia ("Izz") about the vertical axis 26, a moment of inertia ("Ixx") about the heel/toe axis 28, and a moment of inertia ("Iyy") about the front/back axis 30. The methods for determining these moments of inertia for any particular club head are well known to those skilled in the art.

Figure 2:
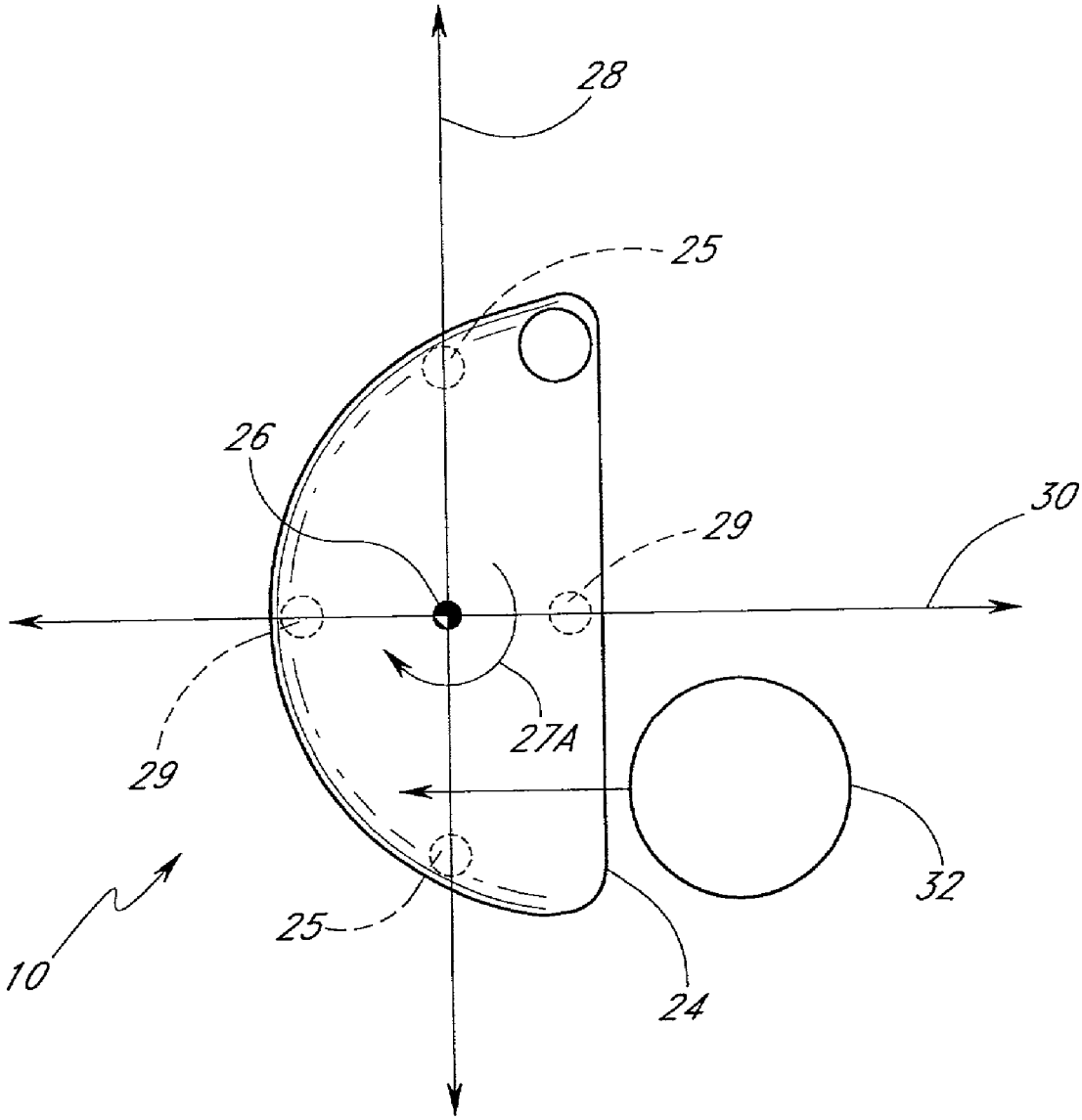
FIG. 2 is a top plan view of a golf club striking a golf ball.

An aspect of Applicant's invention is the realization that preferably most or more preferably all of the performance mass of the club head should be arranged so as to increase the moment of inertia Ixx about the heel/toe axis 28 and the moment of inertia Izz about the vertical axis 26. FIG. 2 is a top plan view of a golf ball 32 hitting the strike face 16 of a club head 10. As is not unusual in golf, the club head 10 is shown striking the golf ball "off-center". In this case, the golf ball 32 has hit the club head 10 near the toe 24 of the club head (i.e., a "side off-center hit"). The side off-center hit causes the club head 10 to twist about the vertical axis 26 as shown by arrow 27A. This tends to produce an inaccurate shot.

To mitigate the twisting about the vertical axis 26 during such side off-center hits, golf club manufacturers have typically sought to increase the golf club's moment of inertia Izz about the vertical axis 26 by concentrating at least some of the performance weight along the heel/toe axis 28. For example, heel/toe weights, which are indicated by the reference number 25, can be added to the club head 10 to increase the club head's moment of inertia Izz about the vertical axis 26. This produces more accurate shots.

Figure 3:
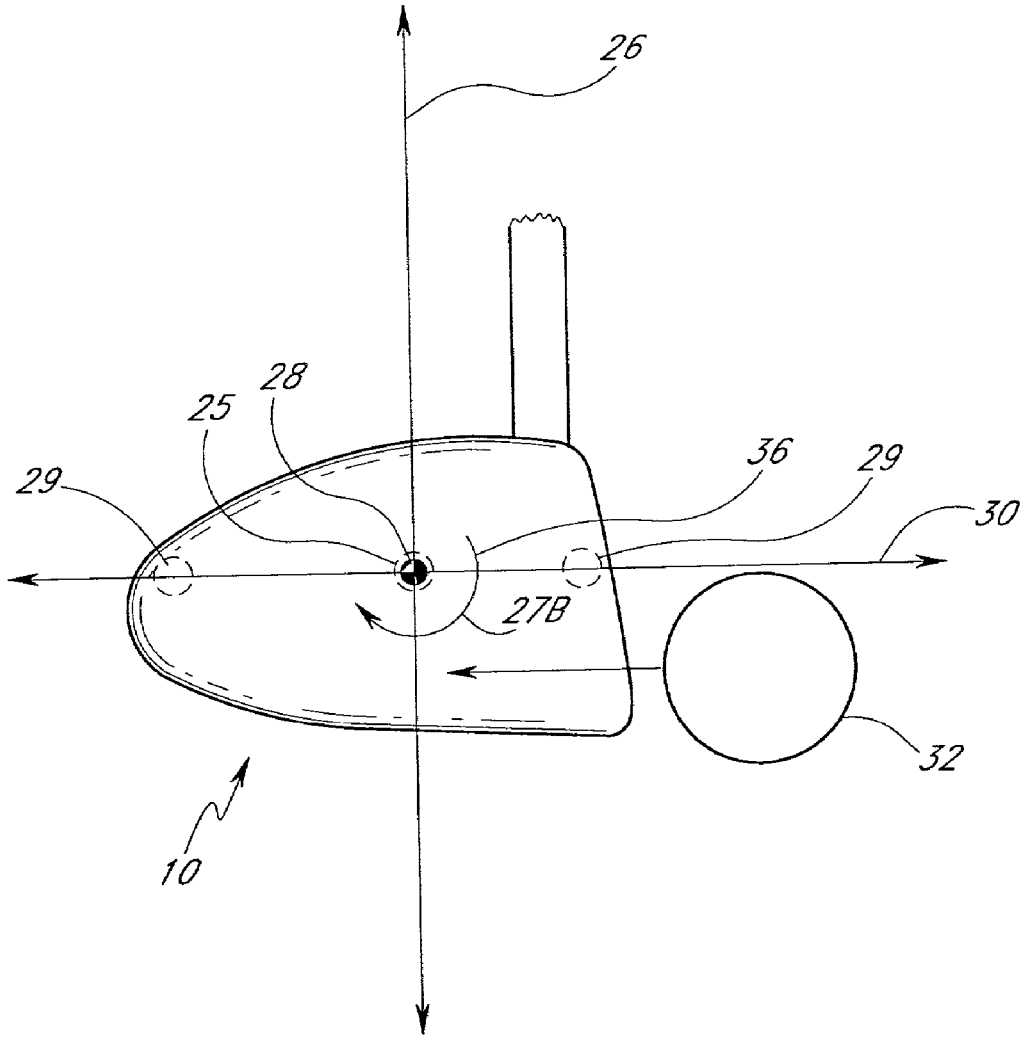
FIG. 3 is a side view of a golf club striking a golf ball.

However, such heel/toe weights 25 do not necessarily improve performance during all off-center hits. For example, FIG. 3 is a side view of the club head 10 striking a golf ball 32. As with FIG. 2, the club head 10 has struck the golf ball 32 off-center. However, in this case, the golf ball 32 has hit the club head 10 below the center of the club head (i.e., a "vertical off-center hit"). This type of off-center hit causes the club head 10 to twist about the heel/toe axis 28 as indicated by arrow 27B. However, heel/toe weights 25 do not increase the club head's moment of inertia Ixx about the heel/toe axis 28. Thus, they do not reduce the tendency of the club head 10 to twist about the heel/toe axis 28. Accordingly, heel/toe weights 25 do not improve the golf club's performance during vertical off-center hits. Heel/toe weights 25 do increase the club head's moment of inertia Iyy about the front/back axis 30. However, it has been determined that during off-center hits the club head 10 tends not to rotate about this axis. Accordingly, the moment of inertia Iyy about the front/back axis 30 is not as effective in improving club head performance.

In contrast, front/back weights 29, which are spaced substantially about the front/back axis 30, increase the club head's moment of inertia Ixx about the heel/toe axis 28. Thus, front/back weights 29 improve the golf club's performance during vertical off-center hits. Moreover, as shown in FIG. 2, such front/back weights 29 also increase the club head's moment of inertia Izz about the vertical axis 26. Therefore, front/back weights 29 improve the club head's performance during side off-center hits and vertical off-center hits.

Figure 4:
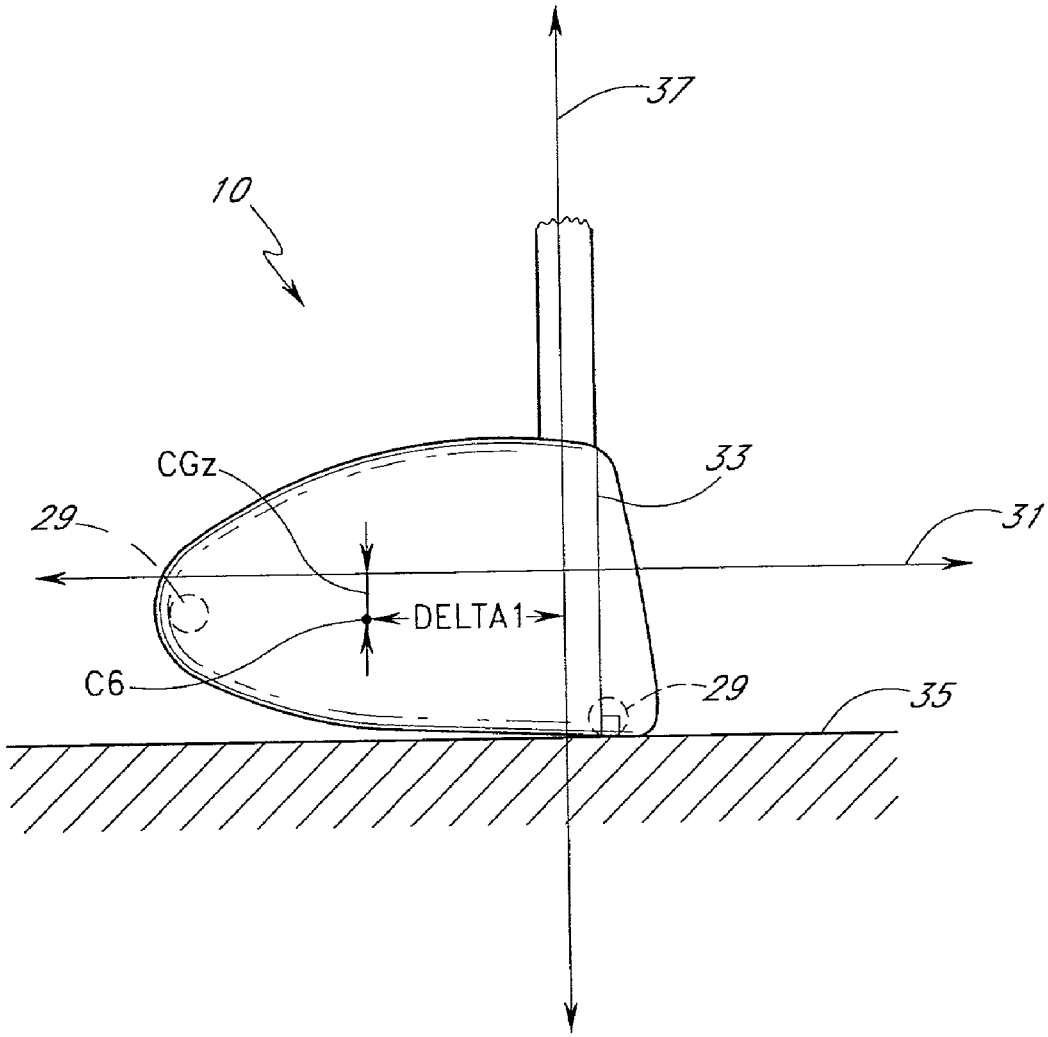
FIG. 4 is another side view of a golf club illustrating the location of the center of gravity.

Another aspect of the invention is the recognition that the performance mass of the club head 10 should also be arranged such that the club head has a low CG. More specifically, as shown in FIG. 4, the CG of the club head 10 is preferably located below a horizontal centerline 31 of the club head (i.e., the line 31 that extends through the geometric center of the strike face 16 and bisects a vertical line 33, which extends perpendicularly from the ground 35 to the top of the strike face 16 when the club head 10 is in the normal address position). Consequently, in some embodiments the performance mass is concentrated below the physical center of the club head. In contrast, most golf clubs have a CG above the horizontal centerline 31.

The vertical distance between the CG and the horizontal centerline 31 will be referred to as CGz. As mentioned above, a club head 10 desirably has a CG that lies below the horizontal centerline 31, which extends through the geometric center of the strike face 16. Preferably, the CG lies at least 1 millimeter below the horizontal centerline 31 (i.e., CGz is at least 1 mm). More preferably, CGz is at least 2 millimeters. It is difficult to design wood-type clubs with a CG below the horizontal centerline 31. Accordingly, the front/back weights 29 of the club head 10 preferably are located entirely below the horizontal center line 31 of the club head. Moreover, moving the CG even a small distance below the horizontal centerline 31 has a large effect on the golf shot. For example, failure to get the golf ball air borne results in drastically reduced shot distance. A low CG helps the golfer get a golf ball air borne. Specifically, a lower CG increases the launch angle of a golf shot because when the CG is below the point of impact the strike face 16 rotates in such away that it increases the loft of the golf club.

The club head 10 preferably should also be arranged such that the CG is located not too far back from a shaft or hosel axis 37 of the club head (i.e., a line that extends axially through the center of the shaft and the hosel). The horizontal distance measured in a direction back from the strike face 16 between the CG and the hosel axis 37 will be referred to as Delta 1. Preferably, Delta 1 is in the range of 12–25 millimeters. More preferably, Delta 1 is in the range of 16–20 millimeters. Most preferably, Delta 1 is in the range of 17–18 millimeters. Delta 1 can be manipulated by varying the mass in front of the CG (i.e., closer to the face) with respect to the mass behind the CG. That is, by increasing the mass behind the CG with respect to the mass in front of the CG, Delta 1 can be increased. In a similar manner, by increasing the mass in front of the CG with the respect t o the mass behind the CG Delta 1 can be decreased. The above ranges for Delta 1 are preferred for several reasons. If Delta 1 is too far forward, the trajectory of the golf ball tends to be too low and to the right, especially in large club heads (e.g., club heads having a head volume greater than 300 $cm^3$). Conversely, if Delta 1 is too far back the trajectory of the golf ball tends to be too high and the golf ball tends to have too much spin.

Figure 5:
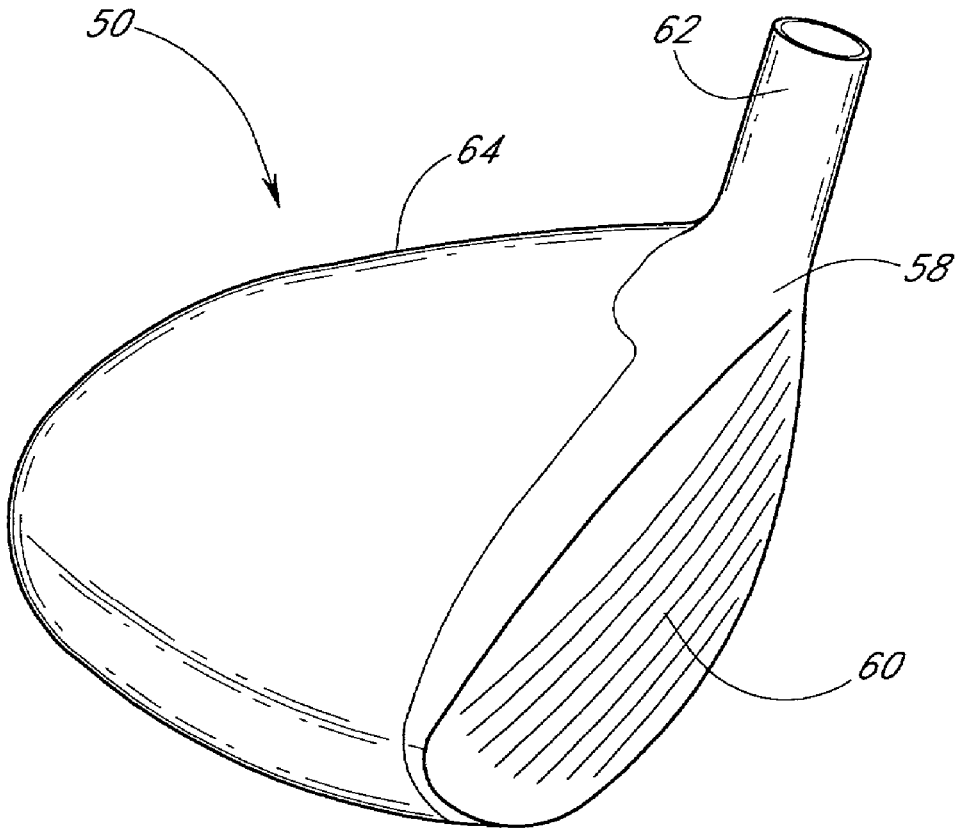
FIG. 5 is a front perspective view of the golf club head having certain features and advantages according to the present invention.

With reference now to FIGS. 5–8 a preferred construction of a golf club bead 50 with certain features and advantages according to the present invention will now be described. As shown in FIG. 5, the club bead 50 is comprised of a strike plate 58. The strike plate 58 defines a front surface or strike face 60 for impacting a golf ball. A hosel 62 extends upwardly from the strike plate 58. The hosel 62 is configured to be coupled to a golf club shaft (not shown) in a well known manner. The strike plate 58 and hosel 62 are preferably made of a strong yet light weight metal, such as titanium or a composite material. Of course, other suitable materials can be used.

The club head 50 further comprises a load bearing outer shell 64 that is preferably attached to the strike plate 58. As with the strike plate 58, the outer shell is preferably made of a strong yet light weight metal, such as, for example, titanium or a composite material. Of course, other suitable materials can be used. The outer shell 64 preferably defines an interior cavity 65 (see FIG. 7) within the club head 50. Together the strike plate 58 and the outer shell 64 define a head volume (i.e., "HV") of the club head 50. The head volume HV represents the volume occupied by the club head 50 and is traditionally measured in $cm^3$ . Head volume is an important design parameter. Other things being equal, it is easier to achieve a higher rotational moment of inertia about the CG in a club head that defines a larger head volume as compared to a club head that defines a smaller head volume. This is because the performance weight can be distributed farther from the CG in a club head with a large head volume. Conversely, other things being equal, it is easier to achieve a lower CG in a club head with a small head volume as compared to a club head with a large head volume. Accordingly, a design compromise must be made between desired inertial characteristics of the club head and the location of the CG. Moreover, golfers generally do not like the look and feel of unusually large or small club heads. Thus, the head volume of the club head 50 preferably is between 200–450 $cm^3$.

Figure 6:
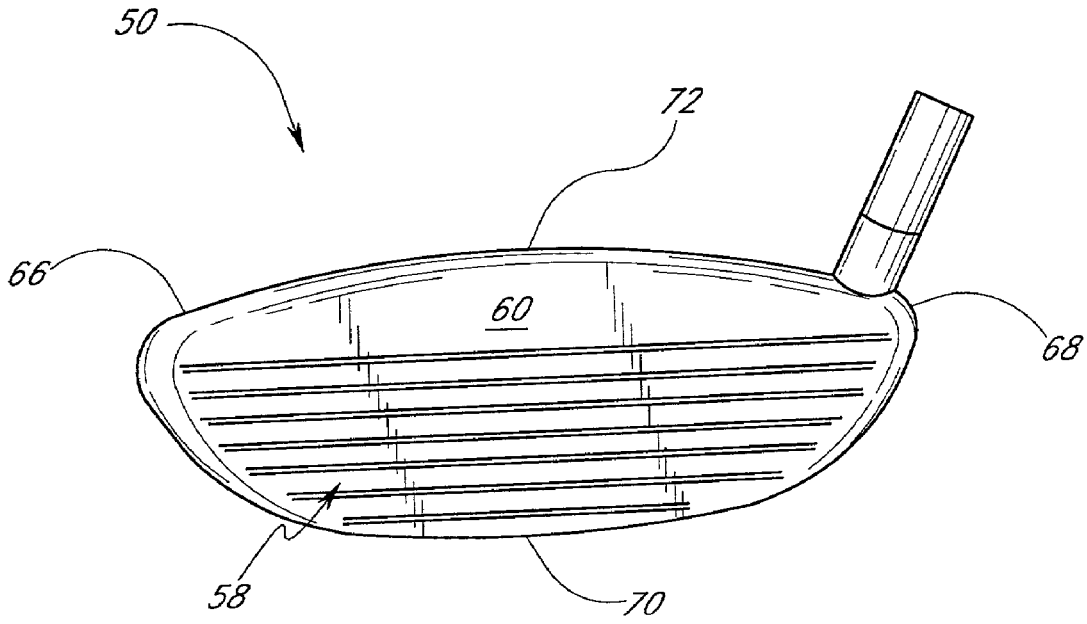
FIG. 6 is a front view of the golf club head of FIG. 5.

With reference to FIG. 6, the club head 50 includes a toe region 66 and a heel region 68, as will be known to those of skill in the art. The bottom of the club head 50 is delimited in part by a sole 70 and the top of the club head is delimited by a crown 72. The features of the club head 50 described up to this point can be considered conventional.

Golfers prefer a driver type golf club to have a total mass of less than 250 grams. Therefore, the club head 50 preferably has a total mass of less than 250 grams. More preferably, the club head 50 has a total mass of less than 230 grams. Most preferably, the club head 50 has a total mass of less than 210 grams. A lighter club head 50 is preferred because it reduces the swing weight of the golf club. However, a lighter club head 50 also has less performance mass available to increase the rotational inertia of the club head 50 about the club head CG. Thus, a design compromise must be made between the total mass of the club head 50 and the desired rotational inertia characteristics of the club head.

The structural members (i.e., the outer shell 64 arid the strike plate 58) comprise approximately 600%–90% of the total mass of the club head 50. The remaining 40%– 10% of the club head mass constitutes the performance mass, which is preferably distributed in weight plugs or weights 74 described below.

Figure 7:
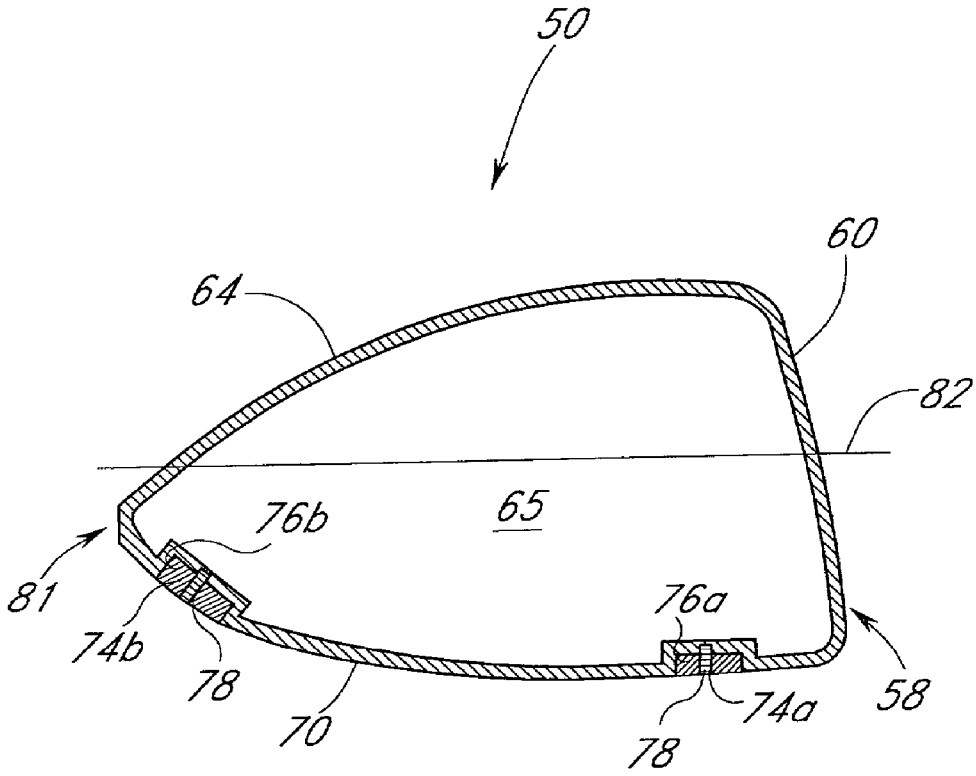
FIG. 7 is a cross-sectional view of the golf club head of FIG. 4.
Figure 8:
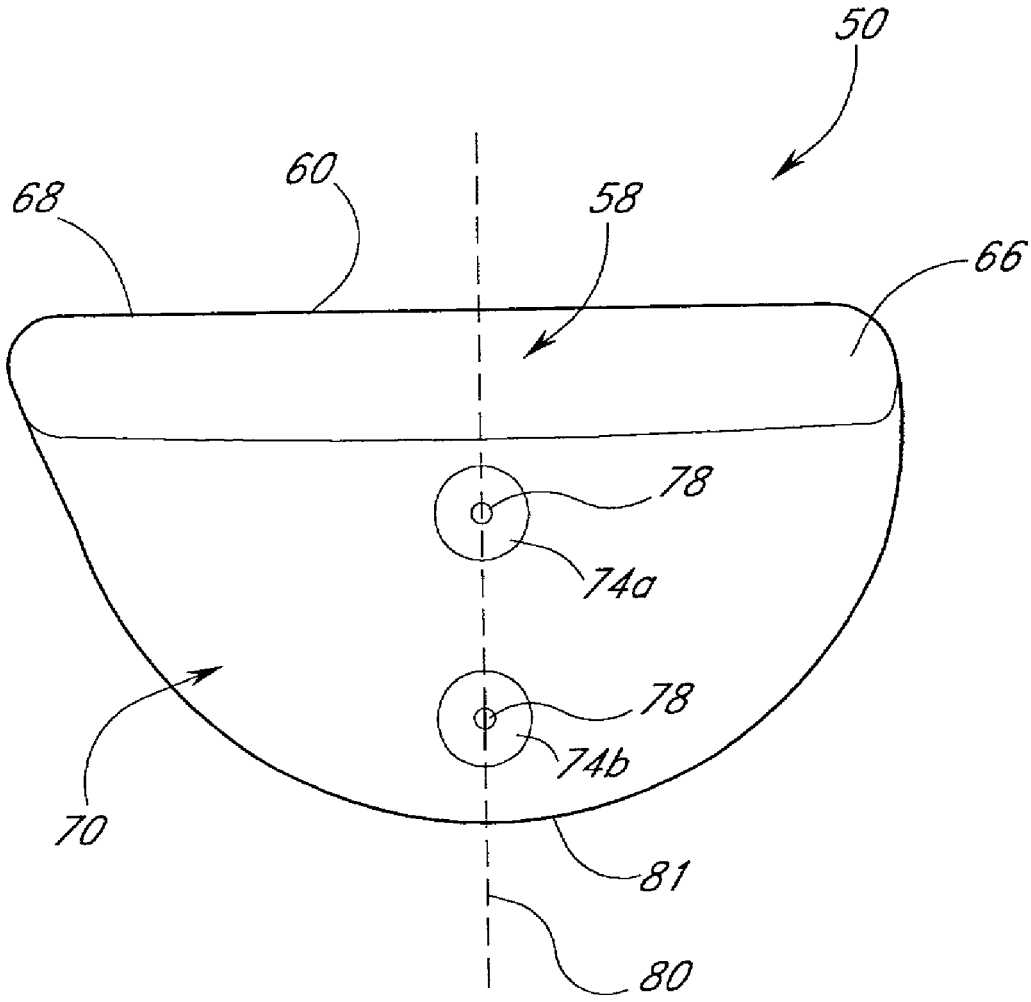
FIG. 8 is a bottom perspective view of the golf club head of FIG. 4.

FIGS. 7 and 8 show cross-sectional side and bottom views, respectively, of the club head 50. In the preferred embodiment, the golf club head 50 includes two or more weights or plugs 74*a*, 74*b* that are situated within corresponding recesses 76*a*, 76*b* formed in the outer shell 64. In the illustrated embodiment, the weights 74*a*, 74*b* are removably coupled to the sole 70 of the club head 50 by screws 78. However, it should be appreciated that the weights 74*a*, 74*b* can be coupled to the club head 50 by using an adhesive, brazing, etc., or the weights may be integrally formed with the sole 70. The weights 74*a*, 74*b* preferably are made of a material, such as, for example, tungsten, that is denser than the material(s) that form the outer shell 64 and the strike plate 58.

As best seen in FIG. 8, the weights 74*a*, 74*b* are preferably located along a front/back axis 80 that extends generally perpendicularly away from the strike face 60 of the club head 50. More preferably, one of the weights 74*a* is located along the front back axis 80 near the strike plate 58 and the other weight 74*b* is also located along the front back axis 80 near a rear end 81 of the club head 50.

In addition, as best seen in FIG. 7, both of the weights 74*a*, 74*b* are preferably located below the horizontal centerline 82 of the club head 50. This arrangement is preferred because it moves the CG of the club head 50 to a position below the horizontal centerline 82.

The club head 50 described above preferably has a moment of inertia Ixx about the heel/toe axis 28 that is significantly greater than conventional club heads (i.e., interior volumes between 200–350$cm^3$ and a mass between 180–250 grams). As mentioned above, the inertial properties of a club head are dependent upon the head volume. Accordingly, the club head 50 preferably, has a moment of inertia Ixx about the heel/toe axis 28 as set forth below in equation 1.

$$Ixx \geq .46 * HV + 77 \quad (1)$$

where: HV is club head volume in units of $cm^3$ $Ixx$ is in units of kg-$mm^2$

More preferably, the club head 50 has a moment of inertia Ixx about the heel/toe axis 28 as set forth below in equation 2.

$$Ixx \geq .46 * HV + 107 \quad (2)$$

where: HV is club head volume in units of $cm^3$ $Ixx$ is in units of kg-$mm^2$

The higher moments of inertia Ixx of equation 2 can be achieved by reducing or holding constant the mass of the shell 64 and/or the strike plate 58 while increasing or holding constant the mass of the weights 74*a*, 74*b* while also giving due consideration to the structural integrity of the club head 50.

In addition, the CG of the club head 50 preferably lies below the horizontal centerline 82 of the club head 50. More preferably, the CG is more than 1 mm below the horizontal centerline 82 of the club head 50. The lower CG can be achieved by increasing the mass of the weights 74*a*, 74*b* while reducing or holding constant the mass of the shell 64 and strike plate 58. The CG can also be reduced by decreasing the thickness of the weights 74*a*, 74*b* and/or decreasing the density of the weights 74*a*, 74*b*.

Preferably, the club head 50 also has a moment of inertia Izz about the vertical axis 26 that is at least 250 kg-$mm^2$. More preferably, the club head has a moment of inertia Izz about the vertical axis 26 of at least 300 kg-$mm^2$. As with the moment of inertia Ixx about the heel/toe axis 28, the moment of inertia Izz about the vertical axis 26 can be increased by reducing or holding constant the mass of the shell 64 and/or the strike plate 58 while increasing or holding constant the mass of the weights 74 while also giving due consideration to the structural integrity of the club head 50.

As mentioned above, the Delta 1 of the club head 50 preferably is less than 30 mm. Preferably, Delta 1 is in the range of 12–25 mm. More preferably, Delta 1 is in the range of 16–20 mm. Most preferably, Delta 1 is in the range of 17–18 mm.

The club head 50 described above has generally traditional dimensions as a driver-type wood (i.e., the head volume is between 200 and 300 $cm^3$). However, some golfers prefer a "large" club head. That is, some golfers prefer a club head that defines an interior volume greater than 300 $cm^3$ and a mass between about 180–210 grams. If such a club head is desired, it can be constructed as described above by enlarging the size of the strike plate 58 and the outer shell 64.

As with the club head 50 described above, the club head preferably has a moment of inertia Ixx about the heel/toe axis 28 as set forth above in equation 1. More preferably, the club head 50 has a moment of inertia Ixx about the heel/toe axis 28 as set forth in equation 2. The CG of the club head 50 also preferably lies below the horizontal centerline 82 of the club head. More preferably, the CG is more than 1 mm below the horizontal centerline 82 of the club head 50. Preferably, the club head 50 also has a moment of inertia Izz about the vertical axis 26 that is at least 250 kg-mm$^2$ . More preferably, the club head has a moment of inertia Izz about the vertical axis 26 of at least 300 kg-mm$^2$. Preferably, Delta 1 is in the range of 12–25 mm. More preferably, Delta 1 is in the range of 16–20 mm. Most preferably, Delta 1 is in the range of 17–18 mm.

In a modified arrangement, the club head 50 may comprise a smaller driver or a fairway wood club head. This smaller club head defines a head volume of less than 200 cm$^3$ and a mass between about 200–250 grams. If such a club head 50 is desired, it also can be constructed as described above by adjusting the shape and size of the strike plate 58 and the outer shell 64. As with the club head 50 described above, a smaller driver or fairway wood type club head preferably has a moment of inertia Ixx about the heel/toe axis 28 as set forth above in equation 1. More preferably, the club head 50 has a moment of inertia Ixx about the heel/toe axis 28 as set forth in equation2. The CG of the club head 50 also preferably lies at least 1 mm below the horizontal centerline 82 of the club head 50. More preferably, the CG is more than 2 mm below the horizontal centerline 82 of the club head 50. Preferably, the club head 50 also has a moment of inertia Izz about the vertical axis 26 that is at least 200 kg-mm$^2$. More preferably, the club head 50 has a moment of inertia Izz about the vertical axis 26 of at least 250 kg-mm$^2$. Delta 1 preferably is in the range of 12– 25 mm. More preferably, Delta 1 is in the range of 16–20 mm. Most preferably, Delta 1 is in the range of 17–18 mm.

For purposes of describing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Moreover, although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A club head for a golf club, the club head comprising a strike face and an outer shell defining a head volume of the club head, said club head having a first moment of inertia about a first axis that extends generally horizontally and parallel to said strike face, a second moment of inertia about a second axis that lies generally vertically and perpendicular to said first axis, and a center of gravity, said center of gravity lying below a horizontal centerline of said club head, wherein said first moment of inertia in units of kg-mm$^2$, is greater than or equal to approximately 77 plus 0.46 times the head volume, in units of cm$^3$.

2. The club head of claim 1, wherein the first moment of inertia in units of kg-mm$^2$ is greater than or equal to approximately 107 plus 0.46 times the head volume in units of cm$^3$.

3. The club head of claim 1, wherein said center of gravity lies more than 1 mm below the horizontal centerline.

4. The club head of claim 3, wherein the first moment of inertia in units of kg-mm$^2$ is greater than or equal to approximately 107 plus 0.46 times the head volume in units of cm$^3$.

5. The club head of claim 1, wherein said club head has a mass of less than 250 grams.

6. The club head of claim 1, wherein said club head has a mass of less than 230 grams.

7. The club head of claim 1, wherein said club head has a mass of less than 210 grams.

8. The club head of claim 1, wherein said club head further includes a hosel and said center of gravity is located between 12 mm and 25 mm from an axis that lies along the center of said hosel.

9. The club head of claim 1, wherein said club head further includes a hosel and said center of gravity is located between 16 mm and 20 mm from an axis that lies along the center of said hosel.

10. The club head of claim 1, wherein said club head further includes a hosel and said center of gravity is located between 17 mm and 18 mm from an axis that lies along the center of said hosel.

11. The club head of claim 1, wherein said head volume is greater than 300 cm$^3$.

12. The club head of claim 11, wherein said club head further includes a hosel and said center of gravity is located between 12 mm and 25 mm from an axis that lies along the center of said hosel.

13. The club head of claim 11, wherein said club head further includes a hosel and said center of gravity is located between 16 mm and 20 mm from an axis that lies along the center of said hosel.

14. The club head of claim 11, wherein said club head further includes a hosel and said center of gravity is located between 17 mm and 18 mm from an axis that lies along the center of said hosel.

15. The club head of claim 1, wherein said head volume is less than 200 cm$^3$.

16. The club head of claim 15, wherein said center of gravity lies more than 2 mm below the horizontal centerline.

17. The club head of claim 15, wherein said club head further includes a hosel and said center of gravity is located between 12 mm and 25 mm from an axis that lies along the center of said hosel.

18. The club head of claim 15, wherein said club head further includes a hosel and said center of gravity is located between 16 mm and 20 mm from an axis that lies along the center of said hosel.

19. The club head of claim 15, wherein said club head further includes a hosel and said center of gravity is located between 17 mm and 18 mm from an axis that lies along the center of said hosel.

20. The club head of claim 1, wherein said second moment of inertia is greater than 250 kg-mm$^2$.

21. The club head of claim 1, wherein said second moment of inertia is greater than 300 kg-mm$^2$.

22. The club head of claim 1, wherein said club head includes a plurality of weights.

23. The club head of claim 22, wherein said plurality of weights lie along a front/back axis that extends generally perpendicular from said strike face.

24. The club head of claim 22, wherein said plurality of weights lie below said horizontal centerline.

25. The club head of claim 24, wherein said plurality of weights also lie along a front/back axis that extends generally perpendicular from said strike face.

26. A golf club head comprising:

an outer shell;

a strike plate coupled to the outer shell, the strike plate having a strike face, the outer shell and the strike face defining a club head volume;

a center of gravity disposed below a horizontal centerline of the club head;

a heel/toe axis extending through the center of gravity, generally parallel to the strike face, and generally horizontal relative to a ground plane when the club bead is at an address position; and a rotational moment of inertia about the heel/toe axis, wherein the rotational moment of inertia about the heel/toe axis is related to the club head volume by the equation $Ixx \geqq 0.46*HV+77$, where Ixx is the rotational moment of inertia about the heel/toe axis in units of kg-mm$^2$ and HV is the club head volume in units of cm$^3$.

27. The golf club head of claim 26, wherein the rotational moment of inertia about the heel/toe axis is related to the club head volume by the equation $Ixx \geqq 0.46*HV+107$, where Ixx is the rotational moment of inertia about the heel/toe axis in units of kg-mm$^2$ and HV is the club head volume in units of cm$^3$.

28. The golf club head of claim 26, wherein the center of gravity is disposed at least 1 mm below the horizontal centerline.

29. The golf club head of claim 28, wherein the center of gravity is disposed more than 2 mm below the horizontal centerline.

30. The golf club head of claim 26, wherein the club head has a total mass of less than 250 grams.

31. The golf club head of claim 30, wherein the club head has a total mass of less than 230 grams.

32. The golf club head of claim 31, wherein the club head has a total mass of less than 210 grams.

33. The golf club head of claim 26, wherein the club head has a total mass within a range of about 180 grams to about 210 grams.

34. The golf club head of claim 26, wherein the club head has a total mass within a range of about 200 grams to about 250 grams.

35. The golf club head of claim 26, further comprising a hosel coupled to the outer shell and a hosel axis extending axially through the hosel, wherein a horizontal distance measured between the center of gravity and the hosel axis is between about 12 mm to about 25 mm.

36. The golf club head of claim 36, wherein the horizontal distance measured between the center of gravity and the hosel axis is between about 16 mm to about 20 mm.

37. The golf club head of claim 36, wherein the horizontal distance measure between the center of gravity and the hosel axis is between about 17 mm to about 18 mm.

38. The golf club head of claim 26, wherein the head volume is between about 200 cm$^3$ to about 450 cm$^3$.

39. The golf club head of claim 38, wherein the head volume is between about 200 cm$^3$ to about 300 cm$^3$.

40. The golf club head of claim 26, wherein the head volume is greater than 300 cm$^3$.

41. The golf club head of claim 26, wherein the head volume is less than 200 cm$^3$.

42. The golf club head of claim 26, wherein the strike plate and outer shell are comprised of titanium or a composite material.

43. The golf club head of claim 26, further comprising:

a vertical axis extending through the center of gravity of the club head generally perpendicular to the heel/toe axis; and a rotational moment of inertia about the vertical axis greater than 250 kg-mm$^2$.

44. The golf club head of claim 43, wherein the rotational moment of inertia about the vertical axis is greater than 300 kg-mm$^2$.

45. The golf club bead of claim 26, further comprising a plurality of removable weights coupled to the outer shell.

46. The golf club head of claim 45, wherein the club head has a total mass, and wherein the removable weights comprise about 10% to about 40% of the total mass.

47. A golf club head comprising:

an outer shell;

a strike plate coupled to the outer shell, the strike plate having a strike face, the outer shell and the strike face defining a club head volume;

a center of gravity disposed at least 1 mm below a horizontal centerline of the club head;

a hosel coupled to the outer shell and a hosel axis extending axially through the hosel, wherein a horizontal distance measured between the center of gravity and the hosel axis is between about 12 mm to about 25 mm;

a heel/toe axis extending through the center of gravity, generally parallel to the strike face, and generally horizontal relative to a ground plane when the club head is at an address position; and a rotational moment of inertia about the heel/toe axis, wherein the rotational moment of inertia about the heel/toe axis is related to the club head volume by the equation $Ixx \geqq 0.46*HV+77$, where Ixx is the rotational moment of inertia about the heel/toe axis in units of kg-mm$^2$ and HV is the club head volume in units of cm$^3$;

a vertical axis extending through the center of gravity of the club head generally perpendicular to the heel/toe axis; and a rotational moment of inertia about the vertical axis greater than 250 kg-mm$^2$;

wherein the golf club head has a total mass of less than 250 grams and a head volume between about 200 cm$^3$ to about 450 cm$^3$.

48. The golf club head of claim 47, wherein the center of gravity is disposed more than 2 mm below the horizontal centerline.

49. The golf club head of claim 47, wherein the club head has a total mass of less than 230 grams.

50. The golf club head of claim 49, wherein the club head has a total mass of less than 210 grams.

51. The golf club head of claim 47, wherein the horizontal distance measured between the center of gravity and the hosel axis is between about 16 mm to about 20 mm.

52. The golf club head of claim 51, wherein the horizontal distance measure between the center of gravity and the hosel axis is between about 17 mm to about 18 mm.

53. The golf club head of claim 47, wherein the rotational moment of inertia about the vertical axis is greater than 300 kg-mm$^2$.

54. The golf club head of claim 47, further comprising a plurality of removable weights coupled to the outer shell.

55. The golf club head of claim 54, wherein the club head has a total mass, and wherein the removable weights comprise about 10% to about 40% of the total mass.

* * * * *

UNITED STATES PATENT AND TRADEMARK OFFICE

CERTIFICATE OF CORRECTION

PATENT NO. : 6,991,558 B2
APPLICATION NO. : 09/821370
DATED : January 31, 2006
INVENTOR(S) : Beach et al.

It is certified that error appears in the above-identified patent and that said Letters Patent is hereby corrected as shown below:

Title page,
Item [57], ABSTRACT,
Line 7, before "axis" delete "horizontal".

Column 1,
Line 31, before "("MOI")" delete "of the".

Column 2,
Line 41, after "head" insert a period.
Line 60, "heal" should be -- heel --.
Line 61, before "28" delete "and".

Column 3,
Line 7, after "10" insert -- head --.
Line 12, after "golf ball" insert -- 32 --.

Column 4,
Line 36, after "with" delete "the".
Line 36, "t o" should be -- to --.
Lines 46 and 48, "bead" should be -- head --.

Column 5,
Line 34, "arid" should be -- and --.
Line 35, "600%" should be -- 60% --.

UNITED STATES PATENT AND TRADEMARK OFFICE

CERTIFICATE OF CORRECTION

PATENT NO. : 6,991,558 B2
APPLICATION NO. : 09/821370
DATED : January 31, 2006
INVENTOR(S) : Beach et al.

It is certified that error appears in the above-identified patent and that said Letters Patent is hereby corrected as shown below:

Column 9,
Line 33, “bead” should be -- head --.

Column 10,
Line 29, “bead” should be -- head --.

Signed and Sealed this

Eleventh Day of July, 2006

JON W. DUDAS
*Director of the United States Patent and Trademark Office*